US006820680B1

(12) United States Patent
Fukase et al.

(10) Patent No.: US 6,820,680 B1
(45) Date of Patent: Nov. 23, 2004

(54) STRIP CASTING

(75) Inventors: Hisahiko Fukase, Tokyo (JP); Shiro Osada, Kanagawa (JP)

(73) Assignee: Castrip, LLC, Charlotte, NC (US)

( * ) Notice: Subject to any disclaimer, the term of this patent is extended or adjusted under 35 U.S.C. 154(b) by 0 days.

(21) Appl. No.: 10/088,153

(22) PCT Filed: Sep. 18, 2000

(86) PCT No.: PCT/AU00/01133

§ 371 (c)(1),
(2), (4) Date: Mar. 13, 2002

(87) PCT Pub. No.: WO01/21342

PCT Pub. Date: Mar. 29, 2001

(30) Foreign Application Priority Data

Sep. 17, 1999 (AU) ..... PQ 2911

(51) Int. Cl.[7] ..... B22D 11/06; B22D 11/08
(52) U.S. Cl. ..... 164/483; 164/491; 164/480
(58) Field of Search ..... 164/480, 483, 164/491, 479, 428, 442, 448

(56) References Cited

U.S. PATENT DOCUMENTS

| | | | | |
|---|---|---|---|---|
| 5,287,912 A | * | 2/1994 | Folder et al. | 164/480 |
| 5,477,911 A | * | 12/1995 | Ginzburg | 164/480 |
| 6,070,646 A | * | 6/2000 | Pleschiutschnigg | 164/442 |
| 6,167,942 B1 | * | 1/2001 | Fish et al. | 164/428 |
| 6,167,943 B1 | * | 1/2001 | Fish et al. | 164/428 |
| 6,397,924 B1 | * | 6/2002 | Fish et al. | 164/480 |
| 6,524,408 B1 | * | 2/2003 | Schmitz et al. | 148/541 |

FOREIGN PATENT DOCUMENTS

| | | | |
|---|---|---|---|
| EP | 0 903 190 A2 | | 3/1999 |
| EP | 0 903 191 A2 | | 3/1999 |
| JP | 55-165260 | * | 12/1980 |
| JP | 59-215257 | * | 12/1984 |
| JP | 1-133644 | * | 5/1989 |
| JP | 11057953 A | | 3/1999 |

* cited by examiner

*Primary Examiner*—Kiley Stoner
*Assistant Examiner*—Len Tran
(74) *Attorney, Agent, or Firm*—Barnes & Thornburg LLP

(57) ABSTRACT

Start up method for initiating casting of metal strip in a twin roll caster comprising parallel casting rolls. A casting pool of molten metal is supported on the casting rolls and confined at the ends of the rolls by side closure plates and the rolls are rotated to deliver cast trip downwardly from the nip between them. One roll is continuously biased laterally toward the other roll either by spring biasing units or by hydraulic biasing units. On start up the gap between rolls is set so as to be less than the thickness of the strip to be cast and the rolls are rotated at such speed that on pouring of molten metal to initiate casting strip is produced to a thickness which is greater than the initial gap between the rolls thereby to cause the biased roll to move bodily away from the other roll to increase the gap between the rolls to accommodate the thickness of the cast strip. This allows initiation of casting without the need for introduction of a dummy bar between the rolls. The peripheral surfaces of rolls may have a negative crown c and the initial gap at the centres of the rolls may be $d_0=2c+g_0$ where $g_0$ is an initial roll edge gap.

23 Claims, 9 Drawing Sheets

STRIP CASTING

CROSS-REFERENCE TO RELATED APPLICATIONS

This application is a U.S. national counterpart application of international application Ser. No. PCT/AU00/01133 filed Sep. 18, 2000, which claims priority to Australian application Ser. No. PQ 2911 filed Sep. 17, 1999.

BACKGROUND AND SUMMARY OF THE INVENTION

This invention relates to the casting of metal strip by continuous casting in a twin roll caster.

In a twin roll caster molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel or series of smaller vessels from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow, although alternative means such as electromagnetic barriers have also been proposed.

The initiation of casting in a twin roll caster presents significant problems, particularly when casting steel strip. On start-up it is necessary to establish a casting pool supported on the rolls. When steady state casting has been established the gap at the nip between the rolls is closed by the solidified strip, but on start-up the molten metal can fall through the gap without solidifying properly and it may then become impossible to produce a coherent strip. Previously, it has been thought necessary to introduce a dummy bar between the casting rolls on start-up so as to block the gap between the rolls while establishing the casting pool and to withdraw the dummy bar with the leading end of the solidified strip as it forms. The need to introduce a dummy bar slows the initial set up procedure preparatory to casting and this procedure must be repeated if a cast is aborted for any reason and it is necessary to restart casting. This is a particular problem when casting steel where the molten metal is at very high temperatures and the refractory components of the metal delivery system must be preheated to high temperature and brought into assembly immediately prior to casting and the molten metal poured within a very short time interval before the refractories can cool significantly. A start up procedure to initiate casting in a twin roll caster without the use of a dummy bar would enable casting to be restarted immediately after an interrupted or aborted cast without the need for extensive resetting of the caster apparatus.

Japanese Patent Publications JP 59215237A and JP 1133644A both disclose proposals for enabling start up of casting in a twin roll caster without the use of a dummy bar. Both of these proposals require an imposed gap variation during start up and a corresponding control of roll speed directed solely to providing a match between the gap and the thickness of the solidified steel shells at the nip in order to close the nip to establish a casting pool. In the proposal disclosed in JP 59215257A start up commences with a small roll gap and casting is started at relatively high roll speed to produce a strip thinner than required. A regular increase in roll gap is then imposed and the speed of the rolls is reduced in order to match an increase in strip thickness with the imposed roll gap variation. In the proposal disclosed in JP 113364&A start up commences with a relatively wide roll gap to enable flow over the rolls to be stabilised and the roll gap is then reduced to allow build up of a casting pool following which the roll gap is increased to produce a strip of the required thickness. Matching an imposed roll gap with an actual thickness of solidifying metal is extraordinarily difficult. Moreover, these proposals assume substantially parallel roll surfaces and an even gap during start up. However, when casting thin steel strip it has been found necessary to employ rolls with machined crowns. More specifically, in order to produce flat strip, the rolls must be machined with a negative crown, ie. the peripheral surface of each roll must have a smaller radius at its central part than at its ends, so that when the rolls undergo thermal expansion during casting they become generally flat so as to produce flat strip. The prior proposals involving an imposed gap control have generally not enabled successful start up with crowned rolls. The present invention provides an improved method in which the gap between the rolls during the casting start up is not imposed, but is responsive to the thickness of the metal being cast during the start up process. The invention makes it possible to use crowned rolls and also enables greater flexibility of casting speed control for optimisation of metal solidification conditions and rate of fill of the casting pool.

DISCLOSURE OF THE INVENTION

According to the invention there is provided a method of casting metal strip comprising:

- holding a pair of chilled casting rolls in parallel relationship so as to form a nip between them and such that at least one of the rolls is moveable bodily and laterally relative to the other roll,
- continuously biasing said one roll laterally toward the other roll,
- setting an initial gap between the rolls at the nip which is less than the thickness of the strip to be cast,
- rotating the rolls in mutually opposite directions such that the peripheral surfaces of the rolls travel downwardly at the nip between them,
- pouring molten metal into the nip between the rotating rolls so as to form a casting pool of molten metal supported on the rolls above the nip and controlling the speed of rotation of the rolls so as to establish casting of a strip delivered downwardly from the nip which at the outset of casting is produced to a thickness which is greater than the initial gap between the rolls so that the initially formed strip forces said one roll bodily away from the other roll against the continuous bias to increase the gap between the rolls to accommodate the thickness of the initially cast strip, and
- continuing casting to produce strip at said thickness and with the gap between the rolls increased beyond the initial gap.

Preferably, the peripheral surfaces of the rolls are negatively crowned when cold by being formed at their midparts to a radius which is less than the radius of end parts of those surfaces, the initial gap being set such that the end parts of the peripheral surfaces of rolls are spaced apart by no more than 1.5 mm.

Preferably, the initial spacing between the end parts of the rolls is in the range 0.2 to 1.4 mm.

The radial negative crown for each roll, being the difference in radius of the midpart and said end parts of the roll surface, may be in the range of 0.1 to 1.5 mm.

Preferably, said other roll is held against lateral bodily movement, said one roll is mounted on a pair of moveable roll carriers which allow said one roll to move bodily laterally of the other roll and said one roll is continuously biased laterally toward the other roll by application of biasing forces to the moveable roll carriers.

The initial gap between the rolls may be set by positioning of a stop means to limit bodily movement of said one roll toward the other. The stop means may for example be a stop which can be set to be engaged by one or both of the moveable roll carriers.

The biasing forces may be applied to the moveable roll carriers by means of biasing springs.

BRIEF DESCRIPTION OF THE DRAWINGS

In order that the invention may be more fully explained, the operation of one particular form of strip caster will be described in some detail with reference to the accompanying drawings in which.

DETAILED DESCRIPTION OF THE DRAWINGS

Figure 1:
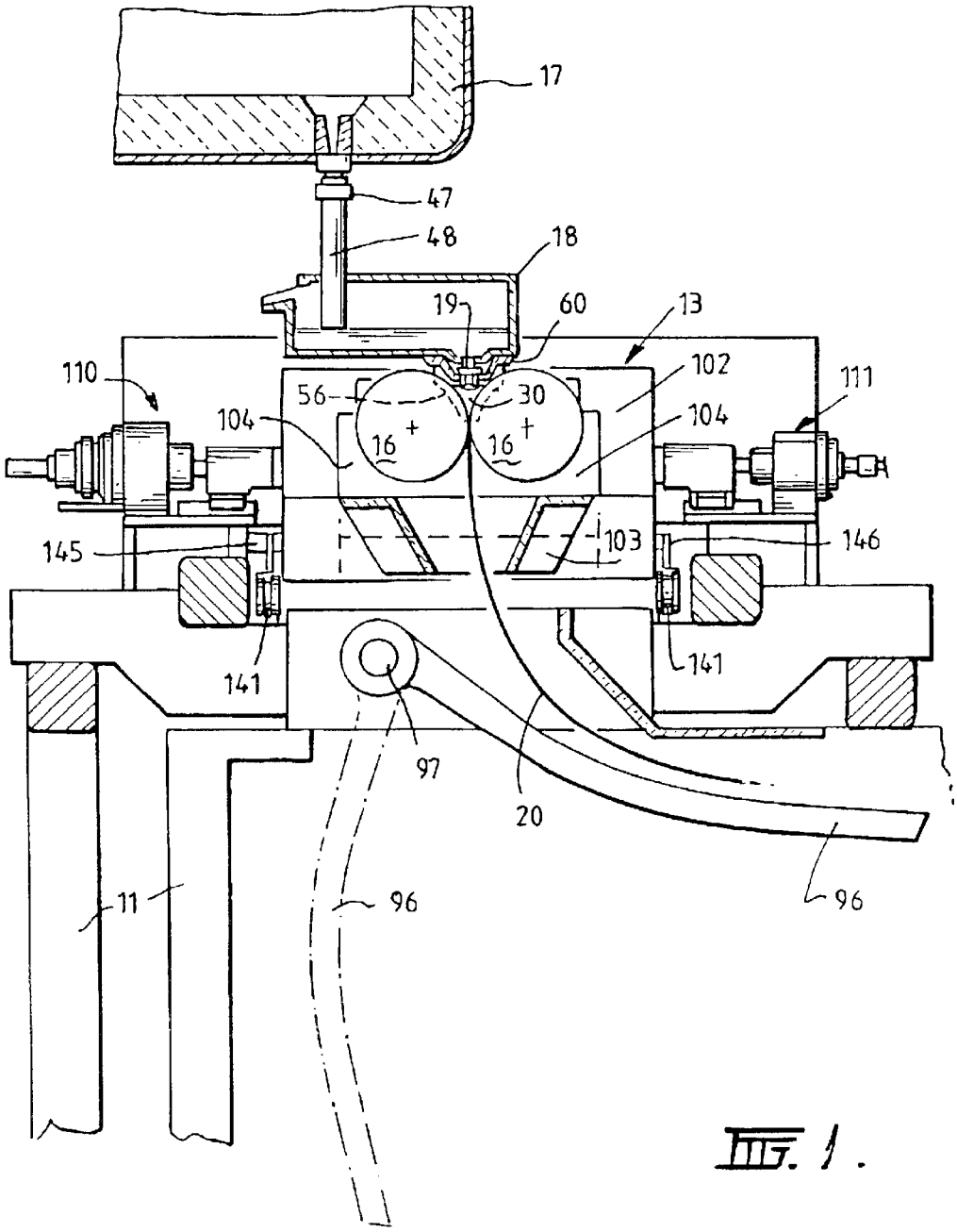
FIG. 1 is a vertical cross section through a strip caster operable in accordance with the present invention.
Figure 2:
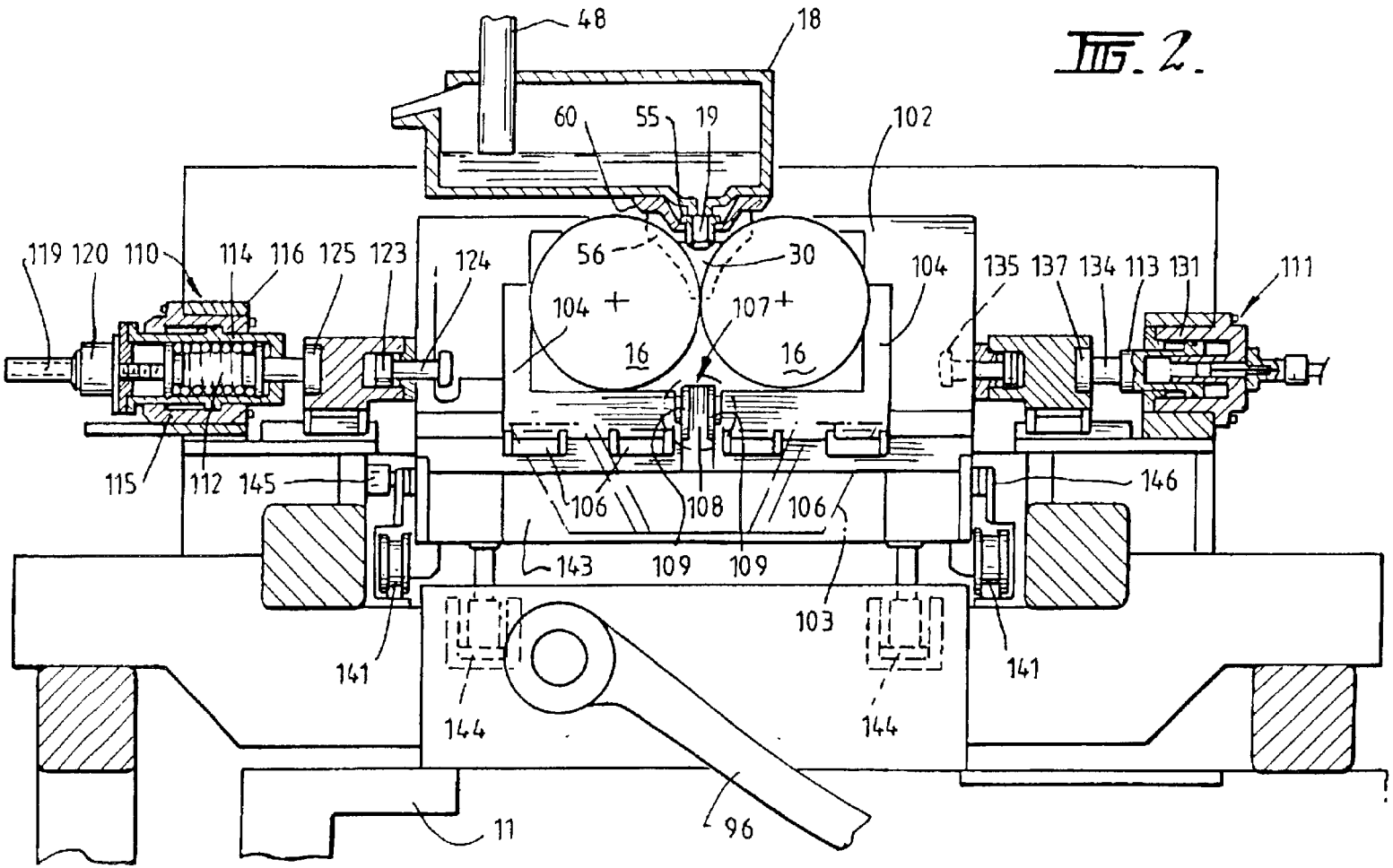
FIG. 2 is an enlargement of part of FIG. 1 illustrating important components of the caster.
Figure 3:
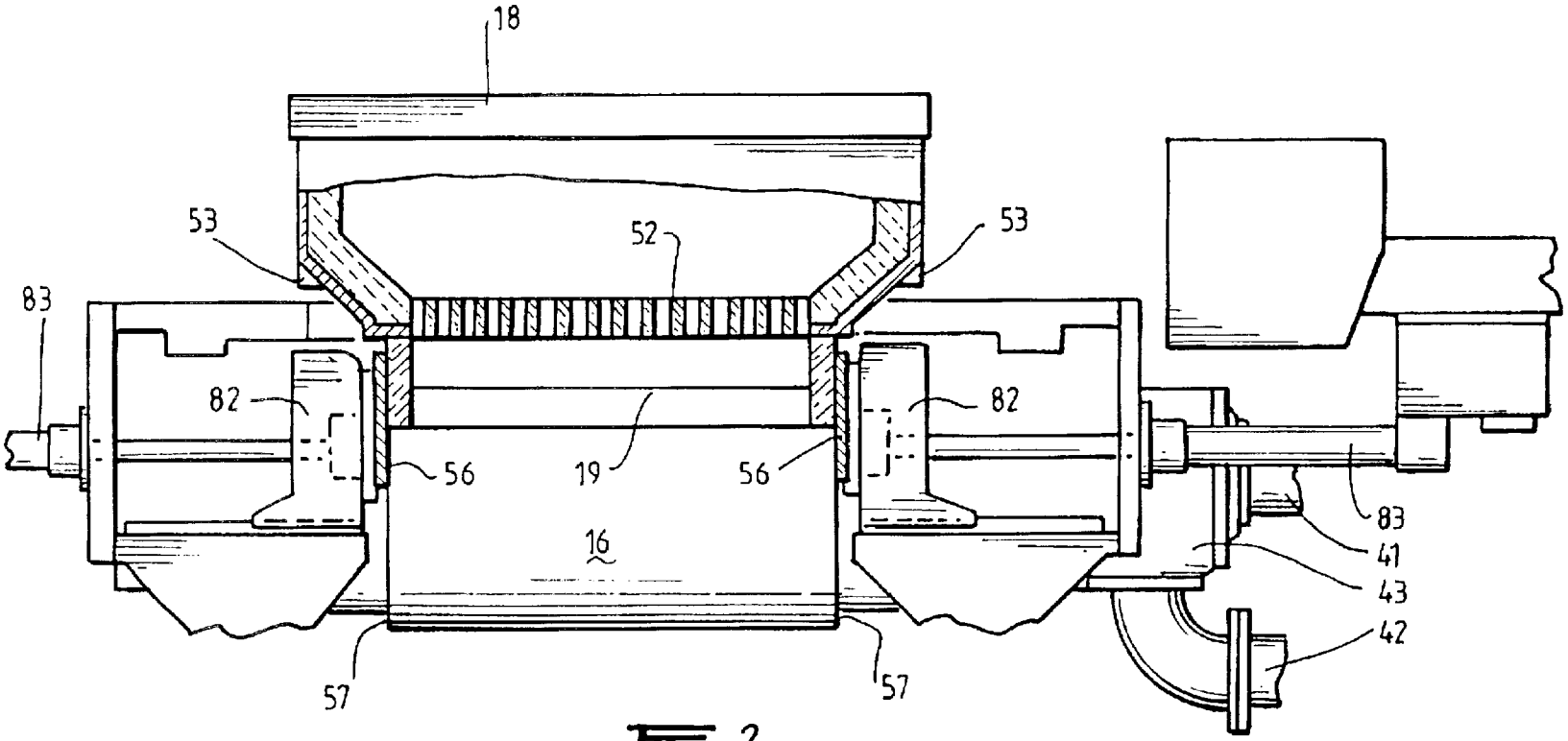
FIG. 3 is a longitudinal cross section through important parts of the caster.
Figure 4:
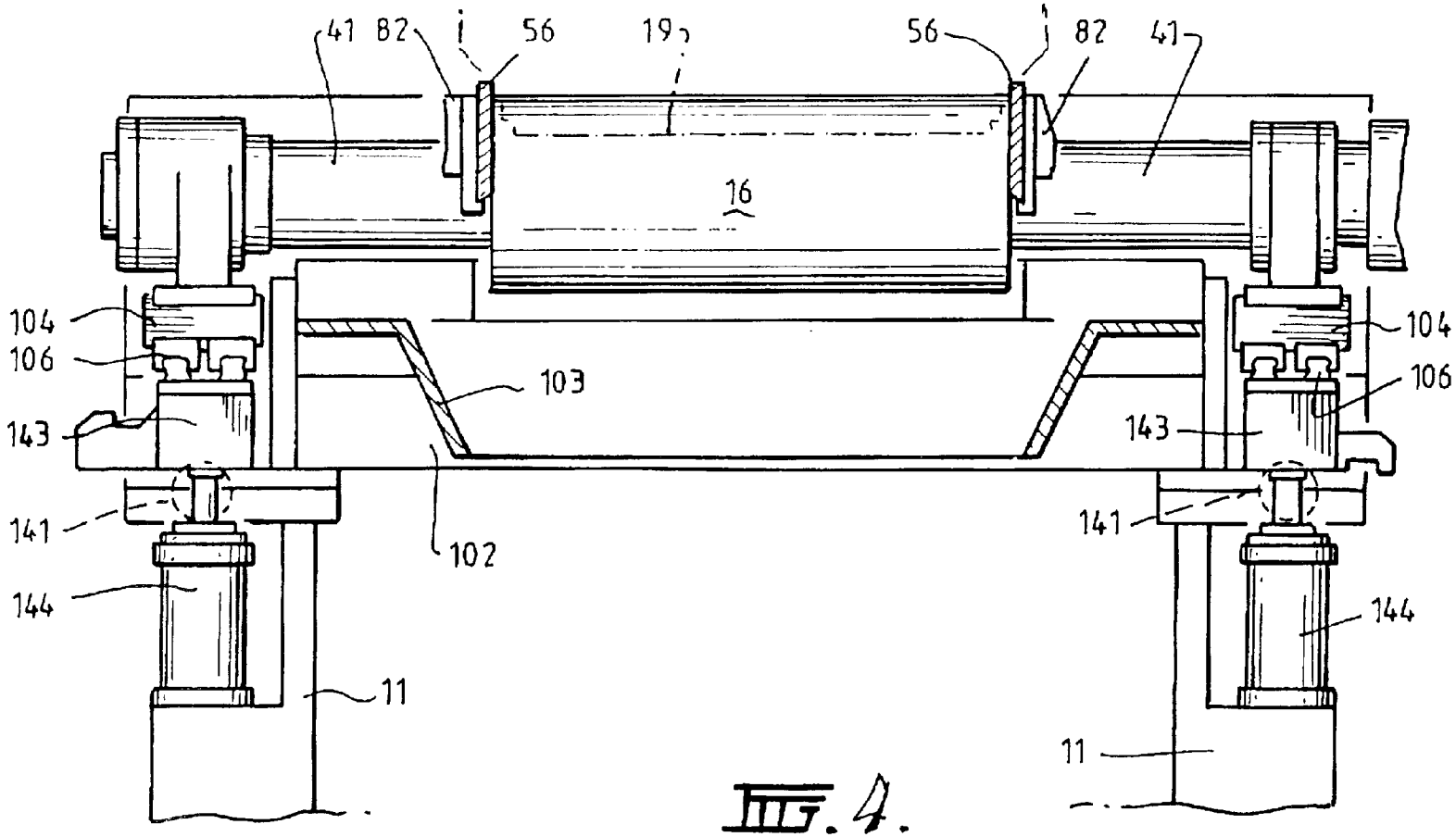
FIG. 4 is an end elevation of the caster.
Figure 5:
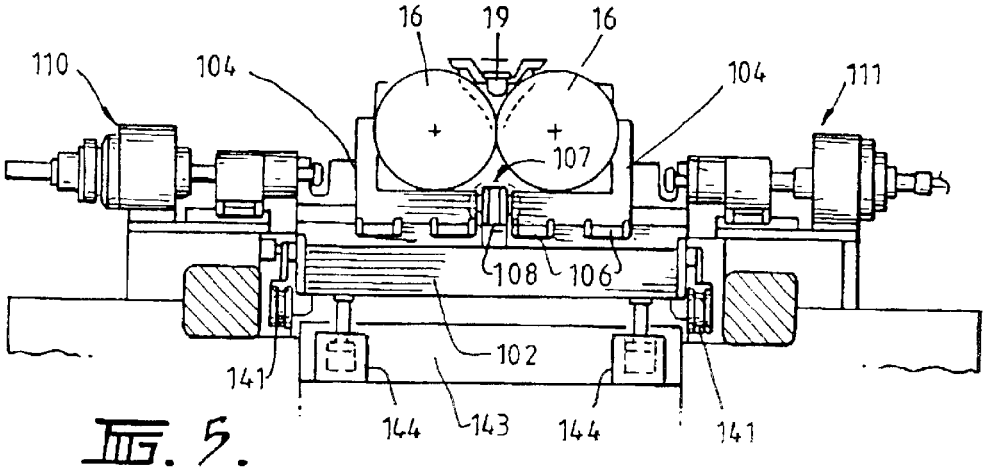
FIGS. 5, 6 and 7 show the caster in varying conditions during casting and during removal of the roll module from the caster.
Figure 6:
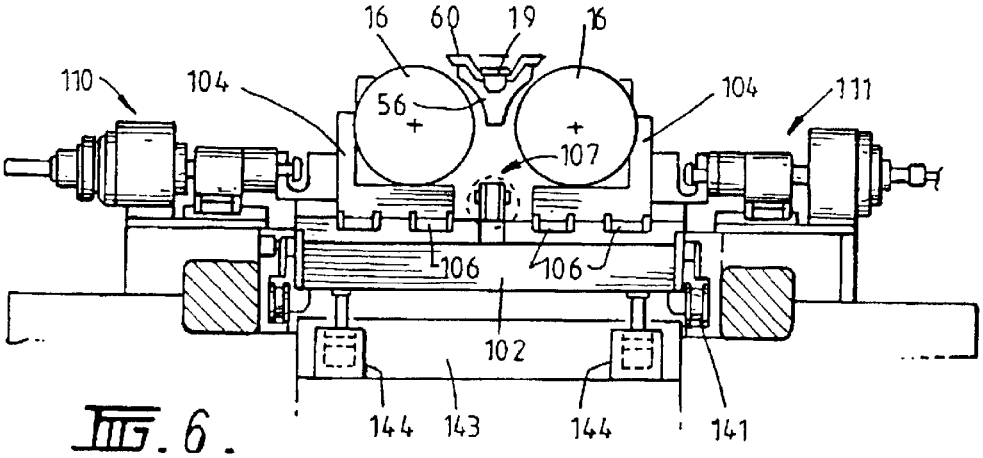
Figure 7:
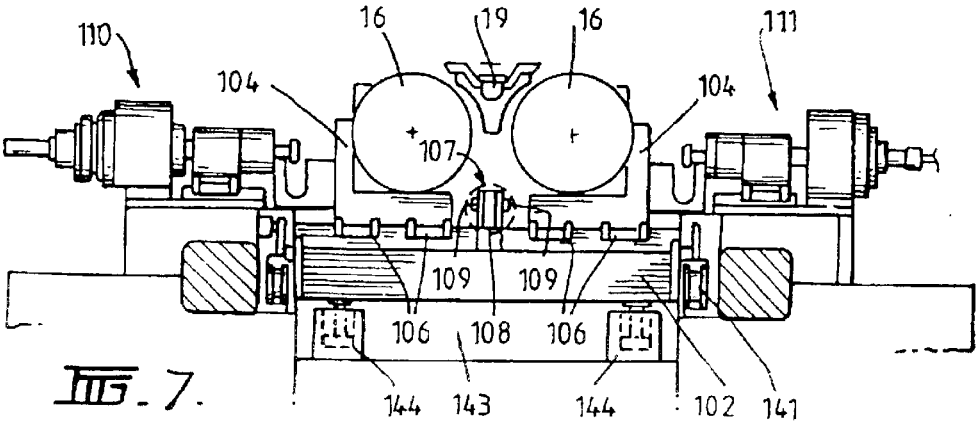

The illustrated caster comprises a main machine frame 11 which stands up from the factory floor (not shown) and supports a casting roll module in the form of a cassette 13 which can be moved into an operative position in the caster as a unit but can readily be removed when the rolls are to be replaced. Cassette 13 carries a pair of parallel casting rolls 16 to which molten metal is supplied during a casting operation from a ladle (not shown) via a tundish 17, distributor 18 and delivery nozzle 39 to create a casting pool 30. Casting rolls 16 are water cooled so that shells solidify on the moving roll surfaces and are brought together at the nip between them to produce a solidified strip product 20 at the roll outlet. This product may be fed to a standard coiler.

Casting rolls 16 are contra-rotated through drive shafts 41 from an electric motor and transmission mounted on the main machine frame. The drive shaft can be disconnected from the transmission when the cassette is to be removed. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The roll may typically be about 500 mm diameter and up to 2000 mm long in order to produce strip product approximately the width of the rolls.

The ladle is of entirely conventional construction and is supported on a rotating turret whence it can be brought into position over the tundish 17 to fill the tundish. The tundish may be fitted with a sliding gate valve 47 actuable by a servo cylinder to allow molten metal to flow from the tundish 17 through the valve 47 and refractory shroud 48 into the distributor 18.

The distributor 18 is also of conventional construction. It is formed as a wide dish made of a refractory material such as magnesium oxide (MgO). One side of the distributor 18 receives molten metal from the tundish 17 and the other side of the distributor 18 is provided with a series of longitudinally spaced metal outlet openings 52. The lower part of the distributor 18 carries mounting brackets 53 for mounting the distributor onto the main caster frame 11 when the cassette is installed in its operative position.

Delivery nozzle 19 is formed as an elongate body made of a refractory material such as alumina graphite. Its lower part is tapered so as to converge inwardly and downwardly so that it can project into the nip between casting rolls 16. Its upper part is formed with outwardly projecting side flanges 55 which locate on a mounting bracket 60 which forms part of the main frame 11.

Nozzle 19 may have a series of horizontally spaced generally vertically extending flow passages to produce a suitably low velocity discharge of metal throughout the width of the rolls and to deliver the molten metal into the nip between the rolls without direct impingement on the roll surfaces at which initial solidification occurs. Alternatively, the nozzle may have a single continuous slot outlet to deliver a low velocity curtain of molten metal directly into the nip between the rolls and/or it may be immersed in the molten metal pool.

The pool is confined at the ends of the rolls by a pair of side closure plates 56 which are held against stepped ends 57 of the rolls when the roll cassette is in its operative position. Side closure plates 56 are made of a strong refractory material, for example boron nitride, and have scalloped side edges to match the curvature of the stepped ends of the rolls. The side plates can be mounted in plate holders 82 which are movable by actuation of a pair of hydraulic cylinder units 83 to bring the side plates into engagement with the stepped ends of the casting rolls to form end closures for the molten pool of metal formed on the casting rolls during a casting operation.

During a casting operation the sliding gate valve 47 is actuated to allow molten metal to pour from the tundish 17 to the distributor 18 and through the metal delivery nozzle 19 whence it flows onto the casting rolls. The head end of the strip product 20 is guided by actuation of an apron table 96 to a pinch roll and thence to a coiling station (not shown). Apron table 96 bangs from pivot mountings 97 on the main frame and can be swung toward the pinch roll by actuation of an hydraulic cylinder unit (not shown) after the clean head end has been formed.

The removable roll cassette 13 is constructed so that the casting rolls 16 can be set up and the nip between them adjusted before the cassette is installed in position in the caster. Moreover when the cassette is installed two pairs of roll biasing units 110, 111 mounted on the main machine frame 11 can be rapidly connected to roll supports on the cassette to provide biasing forces resisting separation of the rolls.

Roll cassette 13 comprises a large frame 102 which carries the rolls 16 and upper part 103 of the refractory enclosure for enclosing the cast strip below the nip. Rolls 16 are mounted on roll supports 104 which carry roll end bearings (not shown) by which the rolls are mounted for rotation about their longitudinal axis in parallel relationship with one another. The two pairs of roll supports 104 are mounted on the roll cassette frame 102 by means of linear bearings 106 whereby they can slide laterally of the cassette frame to provide for bodily movement of the rolls toward and away from one another thus permitting separation and closing movement between the two parallel rolls.

Roll cassette frame 102 also carries two adjustable spacers 107 disposed beneath the rolls about a central vertical plane between the rolls and located between the two pairs of roll supports 104 so as to serve as stops limiting inward movement of the two roll supports thereby to define the minimum width of the nip between the rolls. As explained below the roll biasing units 110, 111 are actuable to move the roll supports inwardly against these central stops but to permit outward springing movement of one of the rolls against preset biasing forces.

Each centralising spacer 107 is in the form of a worm or screw driven jack having a body 108 fixed relative to the central vertical plane of the caster and two ends 109 which can be moved on actuation of the jack equally in opposite directions to permit expansion and contraction of the jack to adjust the width of the nip while maintaining equidistance spacing of the rolls from the central vertical plane of the caster.

Figure 8:
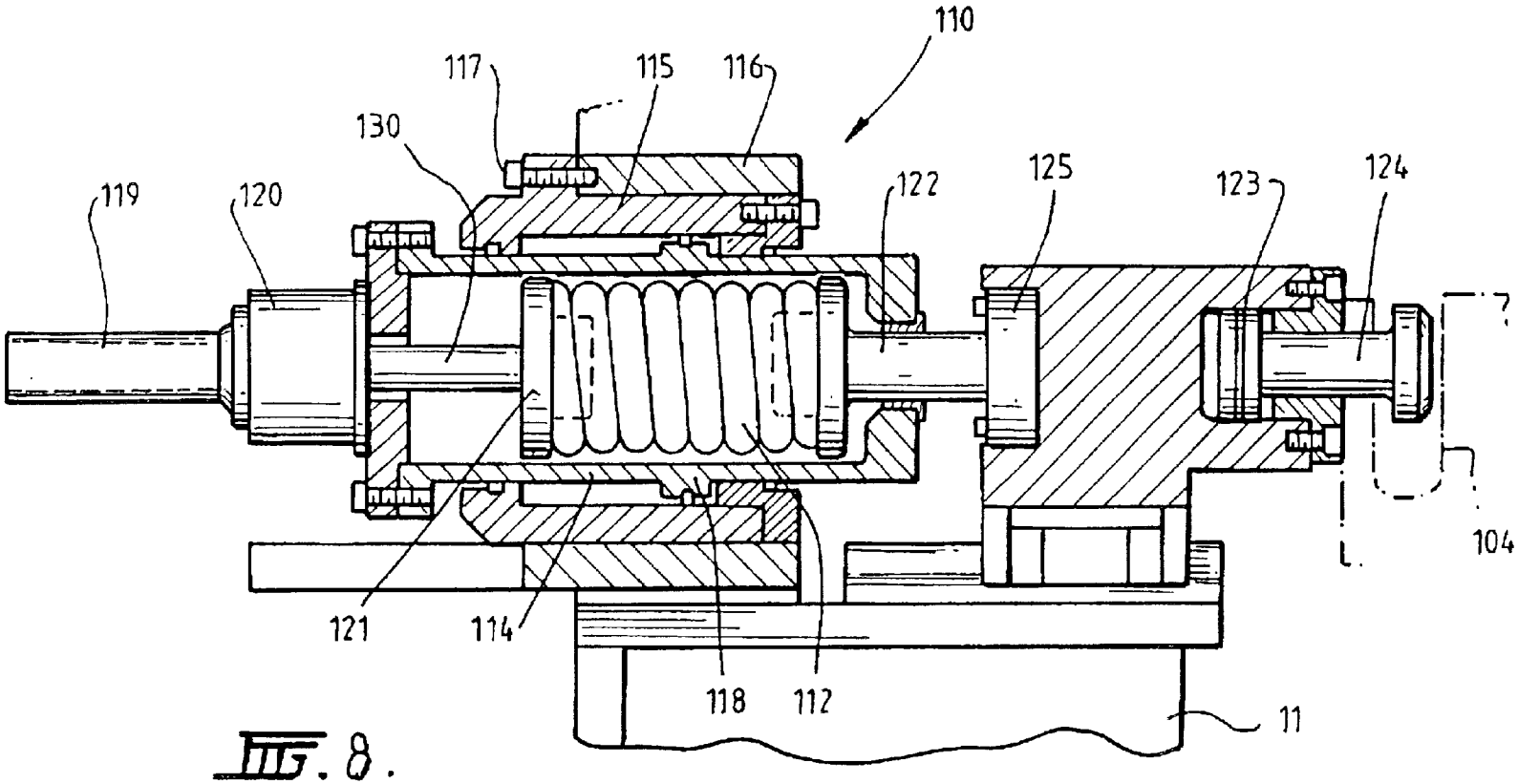
FIG. 8 is a vertical cross-section through a roll biasing unit incorporating a roll biasing spring.
Figure 9:
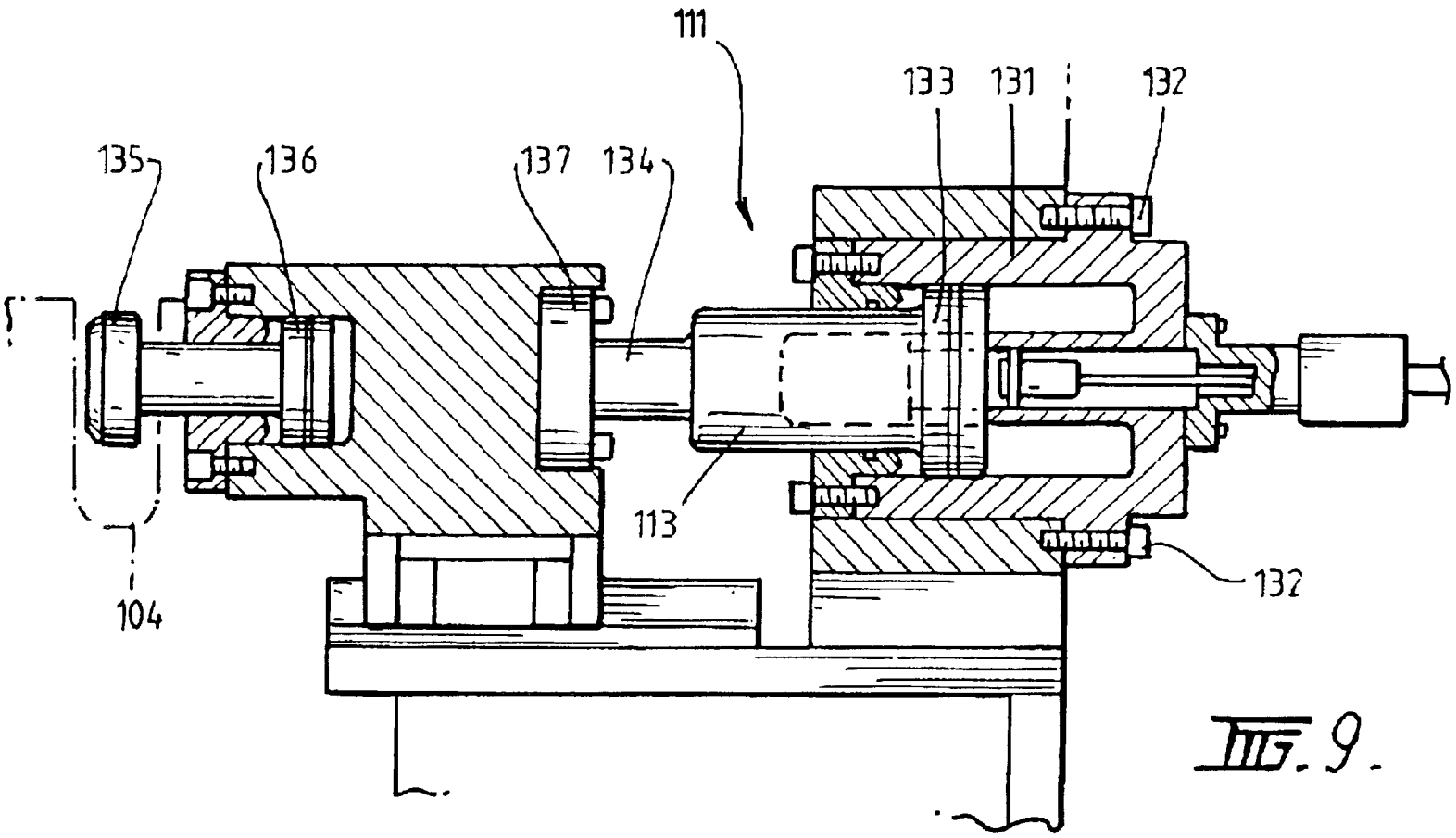
FIG. 9 is a vertical cross-section through a roll biasing unit incorporating a pressure fluid actuator.

The caster is provided with two pairs of roll biasing units 110, 111 connected one pair to the supports 104 of each roll 16. The roll biasing units 110 at one side of the machine are fitted with helical biasing springs 112 to provide biasing forces on the respective roll supports 104 whereas the biasing units 111 at the other side of the machine incorporate hydraulic actuators 113. The detailed construction of the biasing units 110, 111 is illustrated in FIGS. 8 and 9. The arrangement is such as to provide two separate modes of operation. In the first mode the biasing units 111 are locked to hold the respective roll supports 104 of one roll firmly against the central stops 107 and the other roll is free to move laterally against the action of the biasing springs 112 of the units 110. In the alternative mode of operation the biasing units 110 are locked to hold the respective supports 104 of the other roll firmly against the central stops and the hydraulic actuators 113 of the biasing units 111 are operated to provide servo-controlled hydraulic biasing of the respective roll. For normal casting it is possible to use simple spring biasing or servo-controlled biasing.

The detailed construction of biasing units 110 is illustrated in FIG. 8. As shown in that figure, the biasing unit comprises a spring barrel housing 114 disposed within an outer housing 115 which is fixed to the main caster frame 116 by fixing bolts 117.

Spring housing 114 in formed with a piston 118 which runs within the outer housing 115. Spring housing 114 can be set alternatively in an extended position as illustrated in FIG. 8 and a retracted position by flow of hydraulic fluid to and from the cylinder 118. The outer end of spring housing 114 carries a screw Jack 119 operated by a geared motor 120 operable to set the position of a spring reaction plunger 121 connected to the screw jack by a rod 130.

The inner end of the spring 112 acts on a thrust rod structure 122 which is connected to the respective roll support 104 through a load cell 125. The thrust structure is initially pulled into firm engagement with the roll support by a connector 124 which can be extended by operation of a hydraulic cylinder 123 when the biasing unit is to be disconnected.

When biasing unit 110 is connected to its respective roll support 104 with the spring housing 114 set in its extended condition as shown in FIG. 8 the position of the spring housing and screw jack is fixed relative to the machine frame and the position of the spring reaction plunger 121 can be set to adjust the compression of the spring 112 and to serve as a fixed abutment against which the spring can react to apply thrusting force to the thrust structure 122 and directly onto the respective roll support 104. With this arrangement the only relative movement during casting operation is the movement of the roll support 104 and thruster structure 122 as a unit against the biasing spring. Accordingly the spring and the load cell are subjected to only one source of friction load and the load actually applied to the roll support can be very accurately measured by the load cell. Moreover, since the biasing unit acts to bias the roll support 104 inwardly against the stop it can be adjusted to preload the roll support with a required spring biasing force before metal actually passes between the casting rolls and that biasing force will be maintained during a subsequent casting operation.

The detailed construction of biasing units 111 is illustrated in FIG. 9. As shown in that figure the hydraulic actuator 113 is formed by an outer housing structure 131 fixed to the machine frame by fixing studs 132 and an inner piston structure 133 which forms part of a thruster structure 134 which acts on the respective roll support 104 through a load cell 137. The thruster structure is initially pulled into firm engagement with the roll support by a connector 135 which can be extended by actuation of a hydraulic piston and cylinder unit 136 when the thruster structure is to be disconnected from the roll support. Hydraulic actuator 113 can be actuated to move the thruster structure 134 between extended and retracted conditions and when in the extended condition to apply a thrust which is transmitted directly to the roll support bearing 104 through the load cell 137. As in the case of the spring biasing units 110, the only movement which occurs during casting is the movement of the roll support and the thruster structure as a unit relative to the remainder of the biasing unit. Accordingly, the hydraulic actuator and the load cell need only act against one source of friction load and the biasing force applied by the unit can be very accurately controlled and measured. As in the case of the spring loaded biasing units, the direct inward biasing of the roll supports against the fixed stop enables preloading of the roll supports with accurately measured biasing forces before casting commences.

For normal casting the biasing units 111 may be locked to hold the respective roll supports firmly against the central stops simply by applying high pressure fluid to the actuators 113 and the springs 112 of the biasing units 110 may provide the necessary biasing forces on one of the rolls. Alternatively, if the biasing units 111 are to be used to provide servo-controlled biasing forces, the units 110 are locked up by adjusting the positions of the spring reaction plungers 121 to increase the spring forces to a level well in excess of the roll biasing forces required for normal casting. The springs then hold the respective roll carriers firmly against the central stops during normal casting but provide emergency release of the roll if excessive roll separation forces occur.

Roll cassette frame 102 is supported on four wheels 141 whereby it can be moved to bring it into and out of operative position within the caster. On reaching the operative position the whole frame is lifted by operation of a hoist 143 comprising hydraulic cylinder units 144 and then located centrally in the machine.

In accordance with the present invention the centralised spacers or stops 107 are set prior to a casting operation so that at start-up the gap at the nip between casting rolls 16 is very much less than the thickness at which strip is to be cast. When casting thin steel strip, the casting rolls are subjected to molten steel at temperatures in excess of 1200° C. and they therefore undergo significant thermal expansion or bulging under casting conditions. They are accordingly machined with substantial negative crown so as to expand to a generally parallel cylindrical shape under the casting conditions. This negative crown must be allowed for when setting the initial gap between the rolls.

Figure 10:
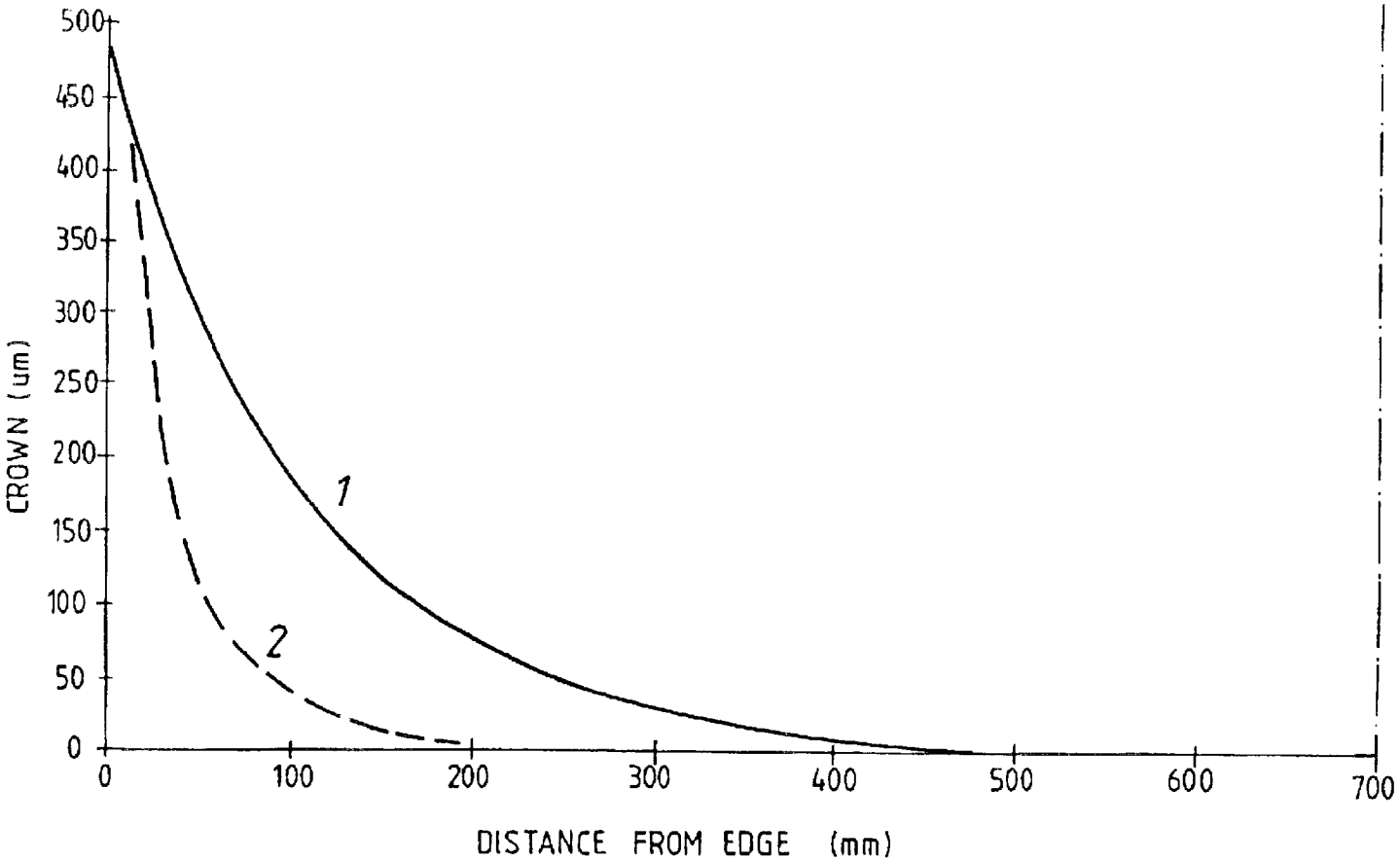
FIG. 10 illustrates two typical roll surface profiles exhibiting negative crown.

FIG. 10 illustrates two typical roll profiles, both exhibiting a negative crown which end parts of the rolls of a radius of the order of 450 microns or 0.4 mm greater than the radius of the peripheral surface at the midpoint of the roll. The crown will typically be 0.4 mm+0.3 mm for a wide range of possible strip widths and roll diameters. A typical roll may be 500 mm in diameter to produce a strip 1300 mm wide. The crown is significant only at the ends of the rolls and is relatively large compared with the typical casting strip thickness of the order of 0.5 to 5 mm.

Figure 11:
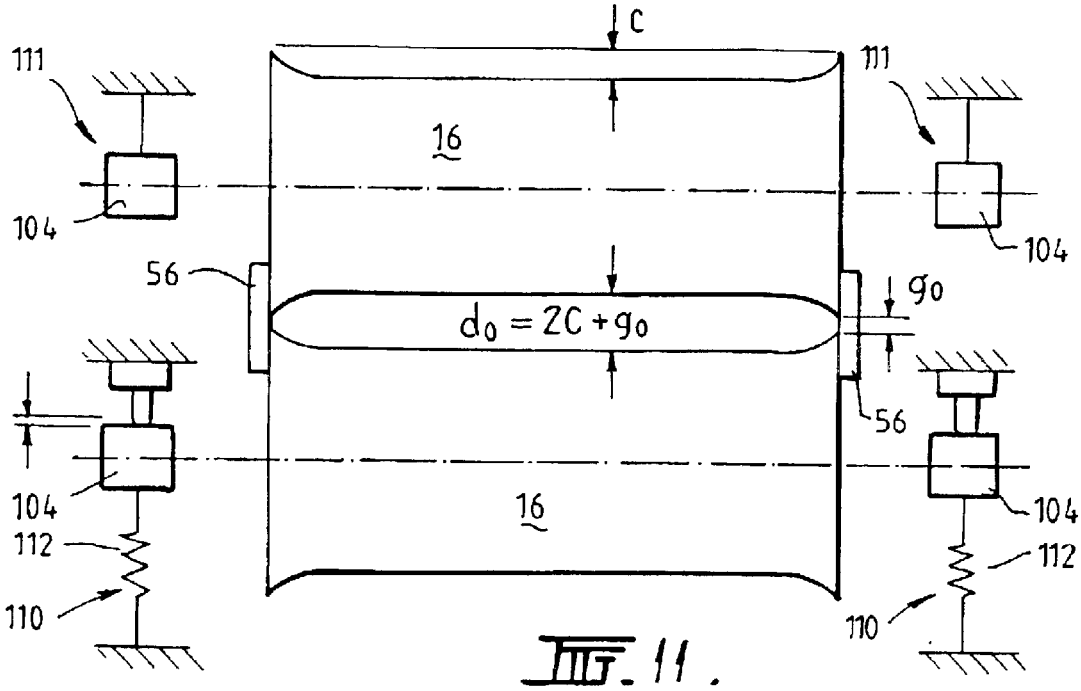
FIG. 11 diagrammatically illustrates the initial set up of two negatively crowned rolls when cold.

FIG. 11 diagrammatically illustrates the initial setting of the roll gap with the rolls in cold condition and accordingly having a negative crown c. The initial gap at the centre of the rolls is $d_0=2c+g_0$ where c is the radial crown of each roll and $g_0$ is the roll edge gap. The roll edge gap $g_0$ is set between a minimum value which ensures that the rolls do not come into accidental or uneven contact and a maximum value which ensures that the molten metal cannot drop freely through the larger gap do at the centre parts of the rolls which would prevent proper closing of the nip and a controlled fill of the casting pool. It has been found that to achieve smooth start up and satisfactory pool filling rate go should preferably be between 0.5 mm and 1.4 mm in order to cast strip in the range 0.2 to 5 mm thickness.

On start-up the rolls are rotated prior to pouring and molten metal is then poured into the nip between the rolls to establish the casting pool and to form a strip. Shells of solidified metal form on the two rolls and these are brought together at the nip to produce the cast strip.

The rate of solidification of the molten metal depends on the rate at which heat is extracted through the casting roll surfaces which in turn depends on the internal cooling system of the roll, the cooling water flow, the texture of the casting surfaces and the speed of the rolls. The speed of the rolls can be controlled during the start-up phase so as to allow rapid build up of molten metal in the casting pool, but also in accordance with the present invention to produce a strip thickness which is substantially greater than the initial gap set in between the rolls. The biased roll (either under spring biasing or hydraulic biasing depending on the mode of operation of the apparatus) then moves laterally under the influence of the relevant biasing units (110 or 111) to accommodate the formation of the strip at the increased thickness.

Figure 12:
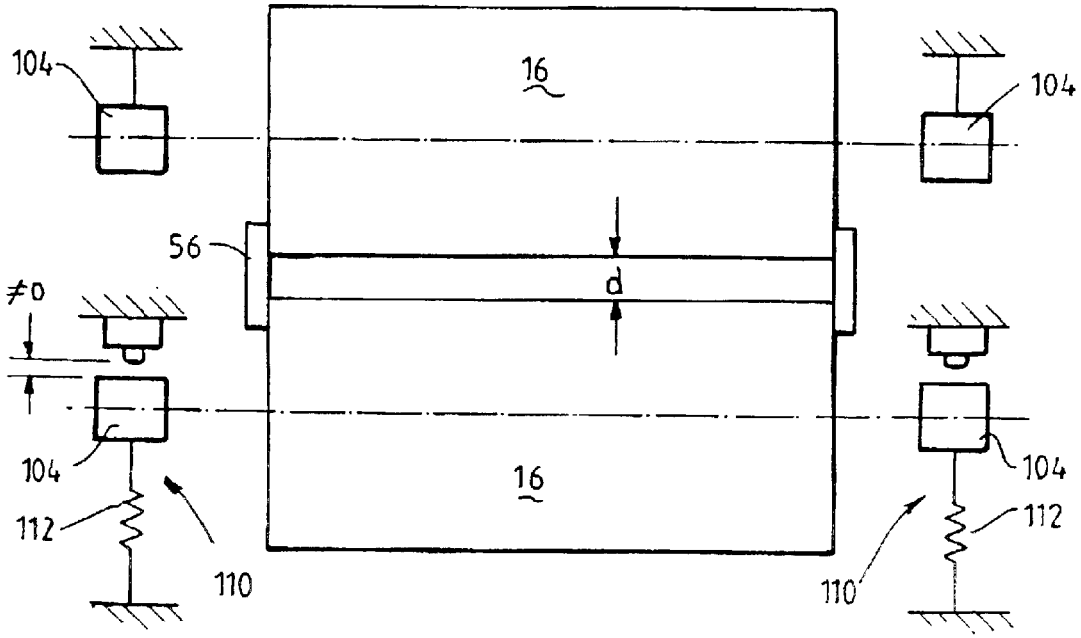
FIG. 12 shows the same two rolls when in hot condition during casting.

Because the initial gap setting is so narrow compared to the rate of delivery of molten metal to the nip and the rate of solidification required to produce the thicker strip, the pool fills quickly and the gap is quickly closed by solidified metal to allow a coherent strip to be established immediately without significant loss of metal and without excessive strip defects. During the start-up phase the casting surfaces of the rolls increase in temperature so that the shape varies to establish a final thermal condition, which is generally flat, as shown in FIG. 12. This may take of the order of 45 seconds and significantly affects the gap between the rolls. However, the final thickness of the strip and accordingly the gap between the rolls will be determined by the speed at which the rolls are rotated, the moving roll being free to move against the applied biasing forces to accommodate the thickness of the strip so produced. Accordingly, the roll speed can be varied during the start up procedure to allow filling of the pool and to establish a desired thickness of the cast strip. More specifically, the speed of rotation of the rolls is controlled as follows:

$$VO\ d_0<\alpha(VpD+\Delta(Q)) \quad (1)$$

$$\alpha>1.0 \quad (2)$$

where

| | |
|---|---|
| $\alpha$ | factor |
| $V_p$ | aimed production speed |
| D | aimed production thickness or roll centre gap |
| $\Delta(Q)$ | an incremental increase of the pouring from upstream to help initial pool fill |

Physical meaning of this Eq.1, 2 are:

if $\alpha=1$ and $V_0d_0=\alpha(vpD+\Delta(Q))$, then the melt can barely start to fill the pool, because the distributor nozzles and level are matched to the production flow rate. Accordingly, the incremental flow rate increase $\Delta(Q)$ cannot prevent significant free drop through the gap.

If $\alpha=2$ and $V_0d_0<\alpha(Vp\ D+\Delta(Q))$, then the pool is filled quickly such as in 5 seconds, depending the other parameters. That is, the pool is plugged by the melt without use of a dummybar at start up.

The value Vp & D are reflecting the actual solidification at the speed Vp and achieved thickness D at full aimed pool level, therefore sufficiently high $\alpha$ value assures the fill up or plugging the roll nip initially by melt and then by solidified shell even under aimed full pool level, when the condition of Eq. 1, 2. are followed.

Most preferably, the a value is 2+0.5.

Once the pool is established to make full width strip to a thickness close to do and roll thermal crowning to develop can almost flat gap in about 30 seconds, as seen in FIG. 12. This causes radial expansion of the rolls to narrow the gap, so the solidified shells start to push the biased rolls back even before the pool has completely filled.

In a specific twin roll caster operated exclusively in accordance with the present invention the following conditions have applied:

| | | |
|---|---|---|
| Casting roll diameter | 500 | mm |
| Casting roll speed | 15 | m/minute |
| Heat flux | 14.5 | $Mw/m^2$ |
| Strip thickness | 1.6–1.55 | mm |
| Roll gap at centre | 1.3 | mm |
| Roll crown | 0.25 | mm (negative) |
| Roll gap at edges | 0.8 | mm |

Under the above conditions, it generally takes up to about 5 seconds for the casting pool to be formed and a coherent strip to be established.

What is claimed is:

1. A method of casting metal strip comprising:

assembling a pair of first and second casing rolls in lateral relationship to form a nip between them with at least one of the rolls moveable laterally relative to the other roll, continuously biasing said first casting roll laterally toward the second casting roll to enable a setting of an initial gap and also a wider gay accommodating casting of strip of a desired thickness, setting the initial gap between the first and second casting rolls at the nip before a casting pool is formed less than the desired thickness of the strip to be initially cast to allow formation of a casting pool supported by peripheral surfaces of the casting rolls without a dummy bar, counter rotating the first and second casting rolls such that the peripheral surfaces of both casting rolls travel toward the nip at a speed of rotation to produce strip of a thickness greater than the initial gap, pouring molten metal to form a casting pool of molten metal supported on the peripheral surfaces of the first and second casting rolls above the nip without a dummy bar, casting strip from the molten metal in the casting pool delivered downwardly from the nip without a dummy bar at outset of casting to a thickness greater than the initial gap setting between the first and second casting rolls by the first casting roll moving laterally away from the second casting roll against the continuous biasing to increase the gap between the casting rolls to accommodate the desired thickness of the cast strip to be cast, and continuing casting to produce strip at said desired thickness and with the gap between the rolls increased beyond the initial gap.

2. A method as claimed in claim 1, wherein the peripheral surfaces of the first and second casting rolls have a radial negative crown by forming at their central portions to radii less than the radii of end portions of those surfaces, the initial gap being set such that the end portions of the peripheral surfaces of casting rolls are spaced apart by no more than 1.5 mm.

3. A method as claimed in claim 2, wherein the spacing between the end portions of the casting rolls is in the range between about 0.5 and 1.4 mm.

4. A method as claimed in claim 2, wherein the radial negative crown for each casting roll is between about 0.1 and 1.5 mm.

5. A method as claimed in claim 1, wherein said the second casting roll is held against lateral movement, and said first casting roll is mounted on a pair of moveable roll carriers to allow said first casting roll to move laterally and be continuously biased laterally toward the second casting roll by application of biasing forces to the moveable roll carriers.

6. A method as claimed in claim 1, wherein the initial gap between the casting rolls is set by positioning of a stop to limit lateral movement of said first casting roll toward the second casting roll.

7. A method as claimed in claim 6, wherein the stop is set to be engaged by one or both of the moveable roll carriers.

8. A method as claimed in claim 3, wherein the, radial negative crown for each casting roll is between about 0.1 and 1.5 mm.

9. A method as claimed in claim 2, wherein the second casting roll is held against lateral movement, and the first casting roll is mounted on a pair of moveable roll carriers to allow said first casting roll to move laterally and be continuously biased laterally toward the second casting roll by application of biasing forces to the moveable rolls carriers.

10. A method as claimed in claim 3, wherein the second casting roll is held against lateral movement, and the first casting roll is mounted on a pair of moveable roll carriers to allow said first casting roll to move laterally and be continuously biased laterally toward the second casting roll by application of biasing forces to the moveable rolls carriers.

11. A method as claimed in claim 4, wherein the second casting roll is held against lateral movement, and the first casting roll is mounted on a pair of moveable roll carriers to allow said first casting roll to move laterally and be continuously biased laterally toward the second casting roll by application of biasing forces to the moveable rolls carriers.

12. A method as claimed in claim 8, wherein the second casting roll is held against lateral movement, and the first casting roll is mounted on a pair of moveable roll carriers to allow said first casting roll to move laterally and be continuously biased laterally toward the second casting, roll by application of biasing forces to the moveable rolls carriers.

13. A method as claimed in claim 2, wherein the initial gap between the rolls is set by positioning of a stop to limit lateral movement of said first casting roll toward the second casting roll.

14. A method as claimed in claim 3, wherein the initial gap between the rolls is set by positioning of a stop to limit lateral movement of said first casting roll toward the second casting roll.

15. A method as claimed in claim 4, wherein the initial gap between the rolls is set by positioning of a stop to limit lateral movement of said first casting roll toward the second casting roll.

16. A method as claimed in claim 8, wherein the initial gap between the casting rolls is set by positioning of a stop to limit lateral movement of said first casting roll toward the second casting roll.

17. A method as claimed in claim 13, wherein the stop is set so as to be engaged by one or both of the moveable roll carriers.

18. A method as claimed in claim 14, wherein the stop is set so as to be engaged by one or both of the moveable roll carriers.

19. A method as claimed in claim 15, wherein the stop is set so as to be engaged by one or both of the moveable roll carriers.

20. A method as claimed in claim 16, wherein the stop is set so as to be engaged by one or both of the moveable roll carriers.

21. A method as claimed in claim 1, wherein said first casting roll is continuously biased laterally toward the second casting roll by a spring mechanism.

22. A method as claimed in claim 1, wherein said first casting roll is continuously biased laterally toward the second casting roll by a hydraulic mechanism.

23. A method as claimed in claim 1, wherein said first casting roll is continuously biased laterally toward the second casting roll by a serve mechanism.

* * * * *